United States Patent [19]

Lautenschläger et al.

[11] Patent Number: 5,052,077

[45] Date of Patent: Oct. 1, 1991

[54] CABINET HINGE WITH ADJUSTMENTS

[75] Inventors: Karl Lautenschläger; Horst Lautenschläger, both of Reinheim; Gerhard Lautenschläger, Brensbach, all of Fed. Rep. of Germany

[73] Assignee: Karl Lautenschläger GmbH & Co. KG, Reinheim, Fed. Rep. of Germany

[21] Appl. No.: 619,027

[22] Filed: Nov. 28, 1990

[30] Foreign Application Priority Data

Apr. 10, 1990 [DE] Fed. Rep. of Germany ..... 4011559

[51] Int. Cl.[5] ..... E05D 7/04

[52] U.S. Cl. ..... 16/238; 16/240; 16/257

[58] Field of Search ..... 16/236, 238, 240, DIG. 43, 16/257

[56] References Cited

U.S. PATENT DOCUMENTS 4,615,072 10/1986 Lautenschlager, Jr. ..... 16/238

4,760,623 8/1988 Toyama ..... 16/238

*Primary Examiner*—Robert L. Spruill

*Assistant Examiner*—Carmine Cuda

[57] ABSTRACT

The invention relates to a carcase-related part of a cabinet hinge, which is an elongated, channel-shaped supporting arm, releasably fastened on the mounting plate by a catch mechanism. The catch mechanism has at the outer end of the mounting plate and supporting arm, a hanger device enabling the supporting arm to tilt relative to the mounting plate. At the inner end of the supporting arm where it straddles the mounting plate, two tongues are provided which can be flexed resiliently parallel to the cabinet wall surface. Each tongue bears a latch section which can be engaged in an associated catch in the mounting plate. The hanger coupling of the supporting arm and mounting plate has an at least partially spherical holding head which is introduced into a slot conforming approximately to the shape of the holding head.

15 Claims, 2 Drawing Sheets

Fig.5
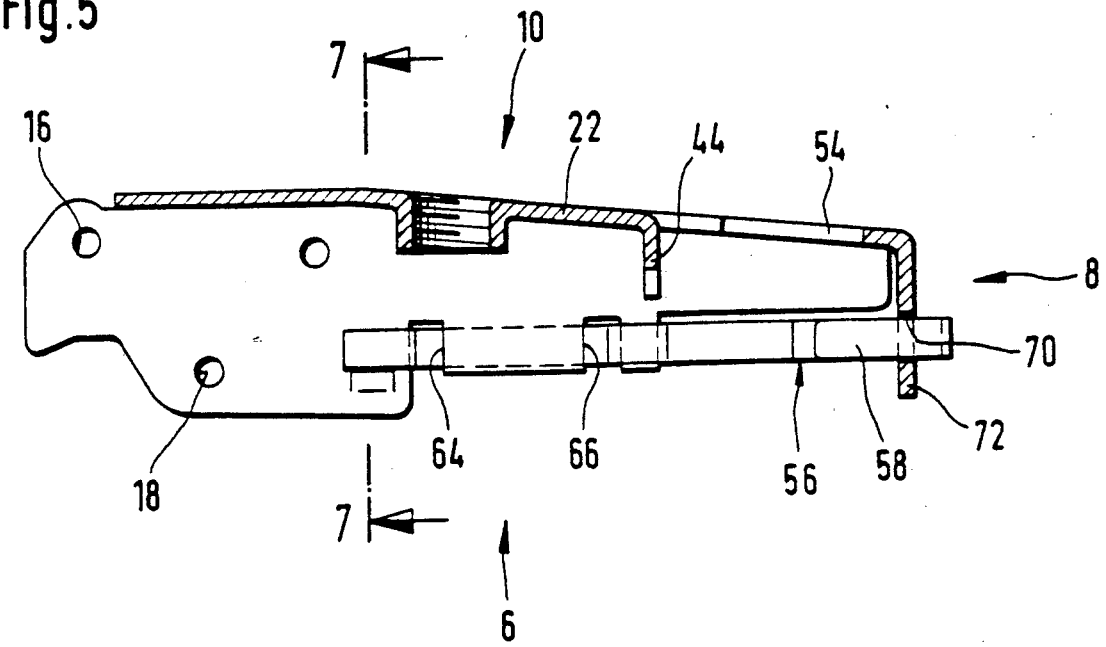
Fig.6
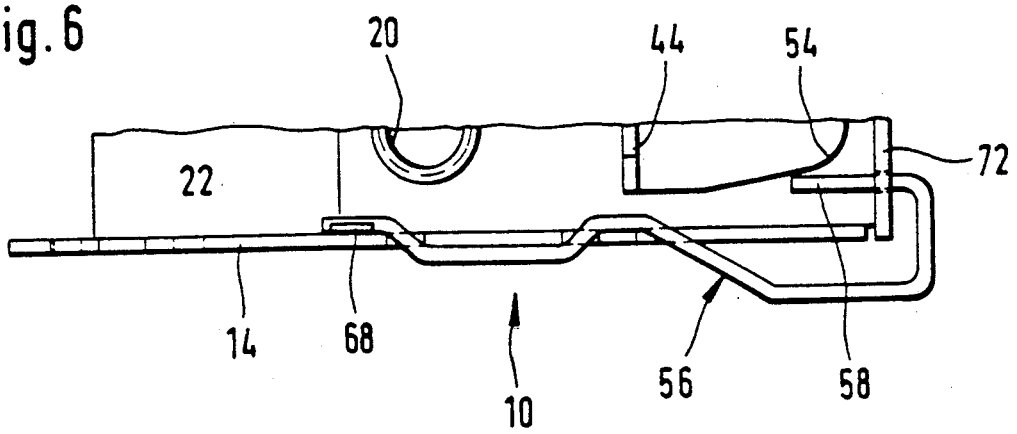
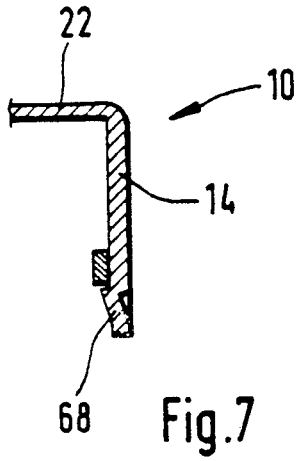
Fig.7
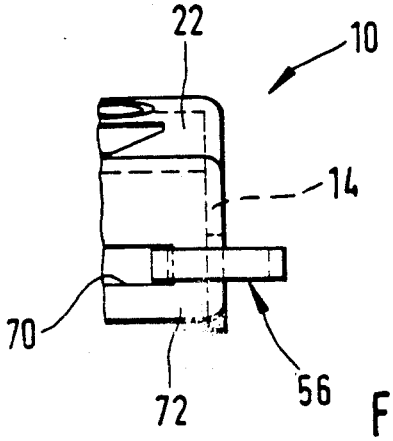
Fig.8

CABINET HINGE WITH ADJUSTMENTS

BACKGROUND OF THE INVENTION

The invention relates to a hinge for hanging a door on the carcase of a cabinet, with a door-related part for fastening to the door and a carcase-related part which is coupled pivotingly to the door-related part by a jointed mechanism, can be fastened removably and adjustably on a mounting plate fastened on the wall of the carcase, and is configured as a supporting arm of channel-shaped cross section straddling the mounting plate. The door-related part is releasably joined to the mounting plate by a catch mechanism having a coupling means at the front end of the mounting plate and of the supporting arm adjacent the door, which permits the rearward portion of the supporting arm inside of the carcase to pivot relative to the mounting plate, while at the inner end of the supporting arm remote from the door, which at least partially straddles the mounting plate at its end pointing into the carcase interior, two tongues resiliently flexible parallel to the carcase wall surface are provided, each having a latch portion engaged with an associated catch in the mounting plate, the latch portions and the catches being able, however, to be disengaged by flexing the tongues against one another parallel to the carcase wall surface, and the tongues having finger grips whereby they can be squeezed together in this manner when the supporting arm is mounted on the mounting plate. The carcase-related parts of modern linkage hinges, which as a rule today are configured as elongated, channel-shaped supporting arms fastened on a mounting plate previously installed on the wall of a cabinet, were originally—and are still largely today—fastened on the mounting plate with screws. The hanging and removal of a door from a cabinet is then a laborious operation and as a rule requires the collaboration of two persons, one to hold the door in the desired alignment with the cabinet, while the door has the hinge pre-installed on it except for the mounting plate, so that the second person can guide the supporting arm of each of the preinstalled hinges onto the mounting plate already installed on the cabinet and screw it in place. Since adjustments of the hinges, especially horizontally toward or away from the cabinet interior, are made by shifting the supporting arm on the mounting plate with the screws loosened, the door must be held precisely in the desired position for installation for the length of time needed t tighten the screws, so as to assure that the adjustment will not be lost again if the door sags of its own weight. Installation is simpler and quicker with hinges developed in recent times, which can be snapped on and off the mounting plate (e.g., DE-OS 31 19 571; FIGS. 3 to 7). To make sure that the hanger coupling of these hinges will not be accidentally or unintentionally disengaged so that the door might come at least partially loose from the cabinet, additional security is often provided by a screw which is additionally tightened after the door is snapped on, and holds the supporting arm against the mounting plate.

On the other hand, the hinge of the kind mentioned above (DE-OS 38 20 338.3) constitutes a substantial improvement. Through the use of a catch mechanism having two independently acting tongues which can be disengaged only by squeezing them simultaneously together it securely prevents accidental disengagement, so that it is unnecessary to fasten the supporting arm by additionally screwing it to the mounting plate. To be able to perform the necessary adjustments of the supporting arm relative to the mounting plate, it is necessary to divide the mounting plate into two parts displaceable relative to one another; the supporting arm is tightly snapped onto the upper mounting plate part, while the upper mounting plate part is adjustable to the desired position relative to the lower mounting plate part. In this case, too, adjusting or mounting screws have to be tightened and/or loosened and retightened. Once the upper mounting plate part has been adjusted with respect to the lower one, the adjustment is preserved regardless or whether or how often the supporting arm is removed from the mounting plate and snapped onto it again. These last-described hinges immediately aroused great interest on account of the advantages described. The only disadvantage with respect to the older hinges is their more complex construction, with the result that the hinges are comparatively expensive.

SUMMARY OF THE INVENTION

The invention is addressed to the problem of improving the abovedescribed cabinet hinges which are so easily and quickly installable and removable by snapping and unsnapping the supporting arm from the mounting plate, so that they will have a decidedly simpler construction and can therefore be made more inexpensively, while preserving their simplicity and reliability of operation.

Setting out from a hinge of the kind described in the beginning, this problem is solved by the invention in the following manner: the hanger coupling of the supporting arm and mounting plate has a holding head, known in itself and of spherical shape at least in sections, disposed on a neck of reduced diameter at the cabinetwall end of a threaded spindle which can be screwed into a tap in the web of the supporting arm, which [holding head] is introduced into a slot in the mounting plate which conforms approximately to the shape of the head is open at the end pointing out of the cabinet for the insertion of the holding head, and narrowed to approximately the diameter of the neck at the top side facing the supporting arm; the latches on the tongues are displaceable by a given amount lengthwise of the supporting arm, parallel to the supporting arm surface, but if the finger grips are not squeezed together they engage the catches and are secured against disengagement therefrom, and on or in the mounting plate an externally controlled adjusting means, which at one end engages the holding head and at the other end engages portion of the supporting arm, is mounted for movement such that, depending on the direction in which it is operated, it displaces the supporting arm lengthwise by pressing either against the holding head or against a portion of the supporting arm. The mounting plate of this hinge is therefore made in one piece and accordingly can be made more cheaply than the known hinges using a two-part mounting plate. The relative alignment of the supporting arm lengthwise on the mounting plate is secured by the adjusting means operated by outside agency which is engaged between the portion of the supporting arm mentioned above, which is a projection, for example, and the head of the threaded spindle which otherwise holds the supporting arm on the mounting plate such that it can be raised and lowered at right angles to the cabinet wall.

The adjusting means in a preferred development of the invention has a threaded spindle in a threaded bore running parallel to the cabinet wall lengthwise through raised portion of the mounting plate and opening into the inner end wall of the narrowed slot. The front end of the threaded spindle facing the linkage mechanism makes contact with the holding head of the threaded spindle that is introduced into the slot, while at its other end a flange is formed which has an annular surface facing toward the cabinet interior, which is engaged by a projection reaching from the supporting arm toward the mounting plate.

A prolongation preferably then reaches centrally from the annular surface of the flange further into the cabinet interior, and can contain a recess for engagement by a tool suitable for rotating the threaded spindle. The recess is preferably formed in a screw head of larger diameter facing the cabinet interior and situated on the free end of the prolongation.

An opening provided in the cabinet-interior end of the supporting arm permits the introduction of the tool intended for the rotation of the threaded spindle.

The projection in contact with the annular surface of the flange is, in a desirable embodiment of the invention, stamped from the web of the supporting arm and then bent down into the interior of the supporting arm, and, at least if the supporting arm is made of spring steel, can also be given the desired spring strength by the appropriate selection of its dimensions The circumferential area of the holding head that is in contact with the end of the threaded spindle when the supporting arm is properly attached to the mounting plate is turned so as to be cylindrical, in order to create a greater area of contact with the end of the threaded spindle rather than the point contact of a spherical holding head.

The adjusting means can alternatively also be a cam journaled on the mounting plate on an axis at right angles to the cabinet wall, whose circumferential surface engages the holding head introduced into the narrowed slot in the mounting plate and, diametrically oppositely, engages a projection reaching down from the supporting arm.

An embodiment has proved to be advantageous in which the cam is a disk that is substantially circular in plan from whose bottom facing the cabinet wall a pivot projects excentrically from its center and turns in a complementary bore in the mounting plate, and in its top facing the web of the supporting arm the circular disk has a recess for engagement by a tool for turning the cam. To permit this tool to engage the recess, an opening is provided in the web of the supporting arm in line with the recess. The free end of the pivot can best project further out from the pivot bore formed in the mounting plate and is secured against removal from the bore by a radially projecting flange formed on it after assembly, or a radially overlapping washer installed after the cam is installed.

In the known hinges, in which the supporting arm has resilient tongues, these tongues are formed from the material of the supporting arm itself, so that they are integral with the supporting arm. The separate installation of these tongues is thus eliminated. Nevertheless, this configuration requires that the supporting arm be made of high-priced annealing sheet steel in order on the one hand to be able to produce the supporting arm by the conventional stamping method from the soft sheet steel, and then the finished supporting arm has to be heat treated to give the as-yet still soft tongues their elasticity.

In an advantageous further development of the invention, provision is made for the supporting arm itself to be made from a lower-cost, nonheat-treating sheet metal. In this case, in an advantageous further development of the invention, the tongues that engage in the catches in the mounting plate are made each of resilient metal strips bent to the required shape, and are then fastened on the supporting arm, this fastening being preferably accomplished by hooking onto the supporting arm the end of the material section opposite the end that forms the latch of each tongue.

In that case the design is made such that the end of the tongue hooked to the supporting arm is inserted into notches in the free edges of the flanges of the supporting arm of channel-shaped cross section and is bent so that it lies alternately against the inner surface and the outer surface of the flange, the free end of the end sections remote from the latches being snapped over a projection reaching into the interior of the supporting arm and preventing the end sections from escaping from the open notches, and the end of the material section forming the locking tab of the tongue is passed through a window in an end wall bent down from the rearward end of the supporting arm, which guides the locking section exclusively in the transverse direction.

BRIEF DESCRIPTION OF THE DRAWINGS

The invention is further explained in the following description of two embodiments, in conjunction with the drawing wherein:

FIG. 5 is a cross-sectional view in the same kind of cross section as in FIGS. 1 to 3 of the supporting arm of a hinge in accordance with the invention configured in a special manner, FIG. 6 is a view of the supporting arm, seen in the direction of arrow 6 in FIG. 5, FIG. 7 is a detail cross section through the supporting arm, as seen in the direction of arrows 7—7 in FIG. 5, and FIG. 8 is a view of the cabinet-interior end of the supporting arm as seen in the direction of arrow 8 in FIG. 5.

DETAILED DESCRIPTION OF THE PREFERRED EMBODIMENTS

Figure 1:
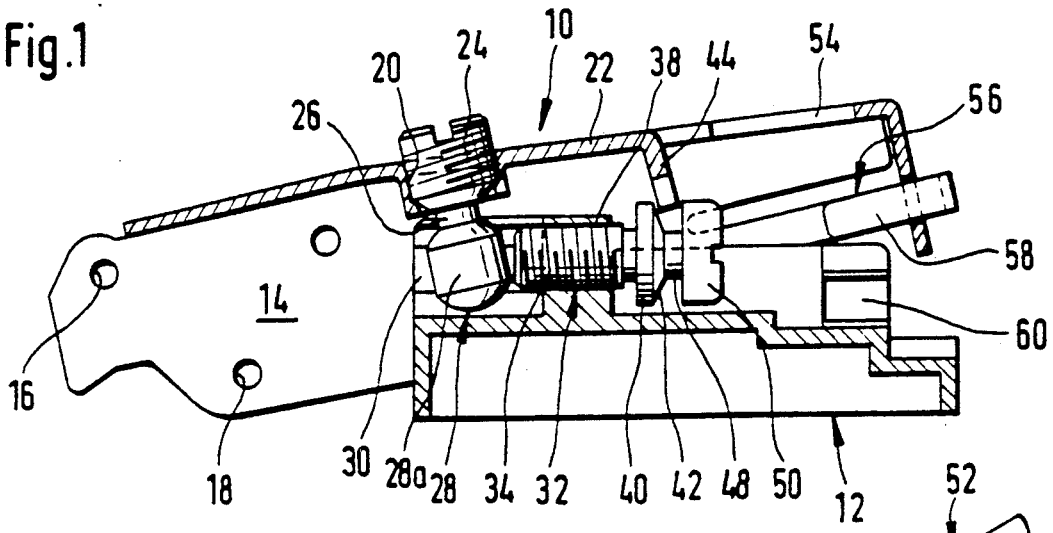
FIG. 1 is a longitudinal section through the supporting arm and the mounting plate of a first embodiment of a hinge in accordance with the invention, wherein the supporting arm is shown placed at an angle relative to the mounting plate but not yet snapped in place.
Figure 2:
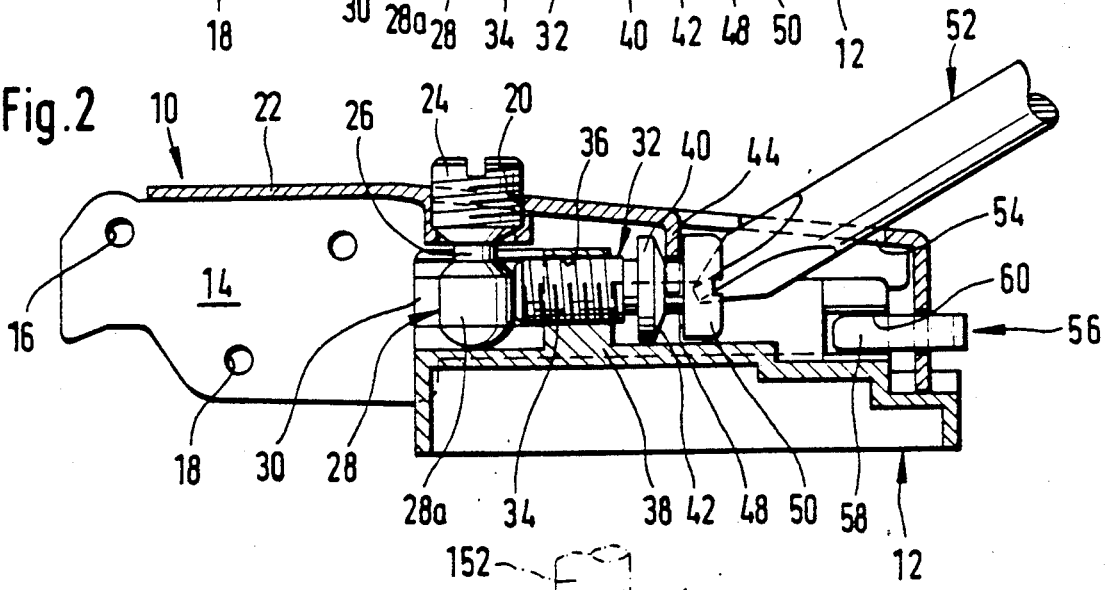
FIG. 2 is a view of the supporting arm and mounting plate corresponding to FIG. 1 in the attached position, the end of a tool being also shown in use for the purpose of adjusting the supporting arm longitudinally on the mounting plate.

In FIGS. 1 and 2 is shown the cabinet wall-related part of a cabinet hinge, namely the elongated supporting arm 10 with the conventional channel-shaped cross section, and the mounting plate 12 which is to be fastened on the wall (not shown) of a cabinet and on which the supporting arm can easily and quickly be mounted and dismounted, in the manner to be described below. The supporting arm 10 has at its front end projecting out of the interior of the cabinet on which it is to be fastened two pivot holes 16 and 18 in its flanges 14, in which the ends of pivot pins, not shown, are riveted, which form the pivots on the cabinet wall for two hinge links whose other ends are carried in the corresponding door-related part, which is to be considered to be a conventional cup fastened in a mortise in the door. The supporting arm 10 represented by way of example thus is a conventional four-joint hinge, not otherwise shown, but it is to be noted that the configuration of the supporting arm and mounting plate provided in the scope of the invention is not limited to four-joint hinges, but can also be applied to hinges with linkage mechanisms of a different kind. The mounting plate 12 in the case represented is an integral metal casting which is fastened in an appropriate manner (not shown) on the cabinet wall, for example by screwing. If the mounting plate is imagined as a so-called "wing plate," lateral wing projections, not visible in the drawings, would be provided on the mounting plate 12, in which holes are provided through which the screws are driven into the cabinet wall.

The supporting arm 10 is to be adjustable on the mounting plate in the conventional manner in two coordinate directions at right angles to one another, namely longitudinally of the supporting arm for the purpose of being able to adjust the gap between the inside face of a closed door linked by the hinge to a cabinet, and in the horizontal direction at right angles thereto in order to change the so-called overlap, i.e., the amount by which the closed door covers the front edges of the cabinet wall. For adjustment in these two coordinate directions an adjusting element is provided for each, whose arrangement on one of the two parts to be adjusted and whose configuration and cooperation with the other part is described hereinbelow.

For the second adjustment mentioned above, of the overlap, a threaded spindle 24 is threaded into a tap in the web 22 between the flanges 14 of the supporting arm 10, and has at its end adjacent the mounting plate a central neck 26 of reduced diameter, and thereon a holding head 28 of reduced diameter. This holding head, which is ball-like at least adjoining the neck 26 and at its diametrically opposite free end, is introduced into a slot 30 in the mounting plate 12, which is open at the door end and narrowed in width at the top facing the supporting arm to approximately the diameter of the neck. Due to the (partially) spherical configuration of the holding head 28 the latter is displaceable not only lengthwise of the groove 30, but also can pivot relative to the mounting plate 12 within a given angular range. In FIG. 1 such an angular position of the supporting arm 10 relative to the mounting plate 12 is represented, and it can be seen that the rear end, i.e., the cabinet-interior end, of the supporting arm 10 comes completely free of the mounting plate, so that the supporting arm 10 can be pulled forward from the mounting plate until the holding head 28 comes free of the slot 30. In FIG. 2, however, the proper position for fastening the supporting arm 10 on the mounting plate is shown, in which the rear end of the supporting arm is swung down onto the mounting plate and partially straddles it. The supporting wall is then, in the manner to be described below, so locked onto the mounting plate that it is impossible to raise the supporting arm to the position shown in FIG. 1 without previous manipulation by an operator. On the other hand, lengthwise displacement of the supporting arm 10 on the mounting plate 12 is basically possible, and for this lengthwise adjustment the adjusting means 32 is provided, which is formed by a threaded spindle 34 which is threaded into a tap 36 running parallel to the cabinet wall in the adjusting direction, which in turn is formed in a projection 38 of the mounting plate 12 such that it leads at its one end into the narrowed slot 30. The door end of the threaded spindle 34 can therefore be screwed through the tap 36 into engagement with the holding head 28. At the other end of the threaded spindle 34, i.e., the end remote from the door, a radially projecting flange 40 is provided, which at its end pointing away from the door and thus into the carcase interior forms an annular surface 42 which is intended to engage a tab 44 cut from the web 22 of the supporting arm 10 and move it along when the adjusting means is screwed toward the cabinet interior. Thus the supporting arm 10 will, of course, be shifted as a whole on the mounting plate toward the cabinet interior by the tab 44 engaging the annular surface 42. If the adjusting means 32 is rotated in the opposite direction, so that the threaded spindle 34 is screwed in the opposite direction, its engagement with the holding head 28 will produce a displacement of this adjusting means 32, while, again, the supporting arm 10 will be positively driven in the opposite direction. It is important in any case that the distance measured between the end of the threaded spindle 34 and the annular surface 42 of the flange 40 be approximately equal to the distance between the circumferential surface of the holding head 28 and the surface of the tab 44 facing it. This assures that the supporting arm will be held on the mounting plate with no free play lengthwise, and the relative longitudinal position of the supporting arm on the mounting plate will depend on the depth to which the threaded spindle 34 is screwed into the tap 36. FIG. 2 shows how a change in this depth can be made. It can be seen that a screw head 50 also adjoins the flange 40 with an intervening neck 48 and in its surface facing away from the threaded spindle 34 and toward the interior of the cabinet it has the conventional recess for engagement by a screwdriver 52, which is, for example, a cross-slot screwdriver of which only the front end is shown in FIG. 2, and which can be introduced through an opening 54 punched through the web 22 of the supporting arm 10.

The back end of the supporting arm 10 is secured against lifting on the mounting plate 12 by a conventional catch mechanism having two resiliently flexible tongues 56 provided on the inner end of the supporting arm remote from the door, each having a latch 58 associated with a catch 60 in the rear end portion of the mounting plate 12 by which the latches 58 can be matingly engaged, although they can be brought out of engagement by flexing the tongues against one another parallel to the cabinet wall surface. To permit this flexing of the tongues to disengage the supporting arm from the mounting plate, each tongue is shaped to form a finger grip such that a section of it protrudes laterally alongside the flanges 14 of the supporting arm 10. To assure that the supporting arm 10 will be fixed in the longitudinal direction of the supporting arm with as little free play as possible, it may be desirable for the tab 44 to be so configured, and disposed at such a distance from the holding head 28, that when the supporting arm 10 is in the engaged position on the mounting plate !2 it will be in contact with the circumferential annular surface 42 of the flange 40 with resilient bias.

For the sake of completeness it is also to be mentioned that the holding head 28 is cylindrically turned at its circumference 28*a* which is in contact with the end of the threaded spindle 34 when the supporting arm 10 is in the proper engaged position on the mounting plate. Thus not only is a contact surface created for engagement by the end of the threaded spindle 34, but also the remaining spherical surfaces of the holding head are made with a longer radius in comparison to the radius of the cylindrical surface 28*a*, so that especially the spherical surface on the threaded spindle side, the same as the corresponding inside surfaces of the slot adjoining the mouth of the slot and preventing the holding head 28 from being withdrawn from the narrowed slot 30, can be made with a comparatively large surface area and can withstand stress accordingly. Moreover, the force seeking to wedge open the mouth areas of the narrowed slot in the event of a tensile stress applied to the holding head will be reduced in comparison to a holding head having spherical surfaces of shorter radius.

Figure 3:
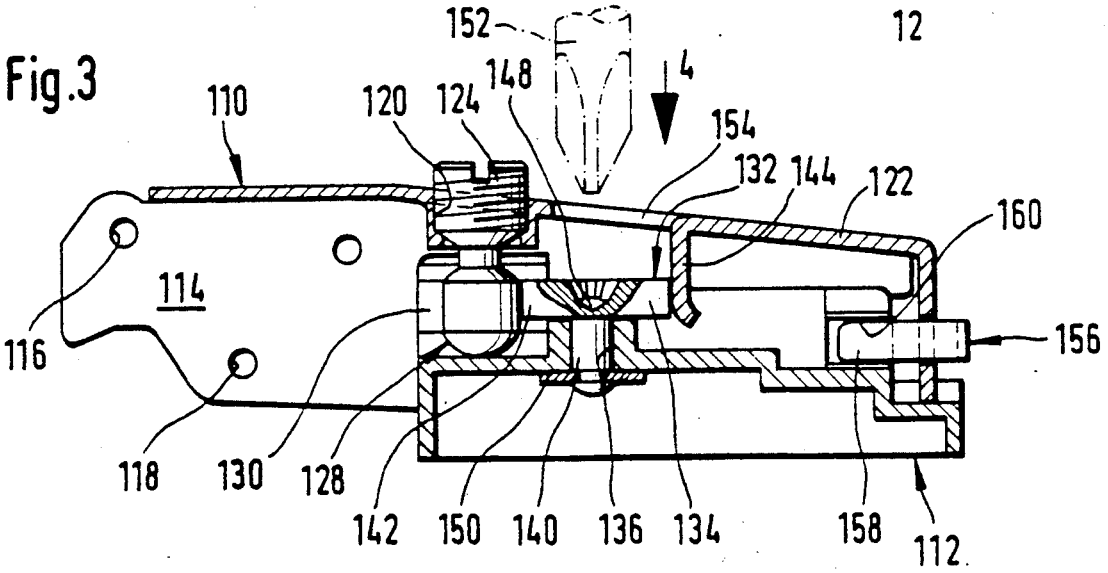
FIG. 3 is a view in the same kind of cross section as FIGS. 1 and 2 of a second embodiment of a hinge in accordance with the invention, in which the supporting arm is snapped in place on the mounting plate.

In FIG. 3 is shown a second embodiment of a hinge according to the invention, which differs from the one described above in connection with FIGS. 1 and 2 only in that the adjusting means 132 provided for adjusting the supporting arm relative to the mounting plate is modified, while the configuration is otherwise the same as that of the previously described embodiment. To avoid repetition, therefore, only the configuration and disposition of the modified adjusting means will be described below, whereas it will suffice otherwise to refer to the foregoing description of FIGS. 1 and 2, since identical parts of the two embodiments are given identical reference numbers preceded, in the case of the embodiment shown in FIG. 3, by a number 1.

Figure 4:
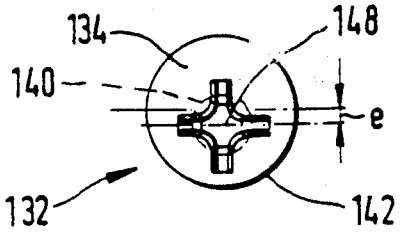
FIG. 4 is a top view of the adjusting means of the embodiment, shown in FIG. 3, of a hinge configured in the manner of the invention.

The adjusting means 132 has a cam which, as it can be seen especially in FIG. 4, is formed by a disk 134 which is circular in plan and from whose underside a pivot 140 projects which is offset from the center of the circle and which is journaled in a complementary bore 136 in the mounting plate 112. A cross-slotted screwdriver recess 148 is provided in the present case in the top of the circular disk, and the front end of the cross-slot screwdriver can be introduced into it through the opening 154 in the web 122 of the supporting arm 110. The circumferential surface 142 of the circular disk forming the cam is in contact on one side with the holding head 128 of the threaded spindle 124 and on the other side with the confronting inside face of the tab 144 on the supporting arm 110.

Depending on the position of the circular disk 134 and the magnitude of the excentricity e (FIG. 4), the supporting arm is fixed in a certain position on the mounting plate, and by turning the circular disk with the cross-slot screwdriver 152 a change can be made in the relative longitudinal position of the supporting arm 110 on the mounting plate 112.

In the embodiment shown, the adjusting means 132 is secured against unintentional loss due to the escape of the pivot 140 from the bore 136, by a disk 150 riveted to the protruding end of pivot 140 that is passed through the bore 136. The disk 150 can also be a plate spring engaging with resilient bias the mounting plate material surrounding the pivot bore 136, thus urging the bottom of the circular disk 134 firmly against the mounting plate. This maintains a certain friction between the bottom of the circular disk 134 and between disk 150 and the mounting plate, which assures that the circular disk 134 will not be able to rotate too easily and therefore accidentally, thereby changing the adjustment of the supporting arm 110 on the mounting plate 112. This effect might be enhanced by providing detent teeth between the bottom of the circular disk and the confronting surface of the mounting plate and/or such detent teeth between the disk 150 and the associated surface of the mounting plate 112.

In FIGS. 5 to 8 the supporting arm of the embodiment shown in FIGS. 1 and 2 is shown separately, for the purpose of representing a configuration of the supporting arm 10 which differs from the known hinges with two resilient tongues in the rearward part of the supporting arm in that these tongues 56 with the latches 58 are in this case parts made separately from spring steel strips installed on the supporting arm 10. The spring steel strips are given a number of bends in the manner best seen in FIG. 6, and then bent back to form the latches 58 and fastened to the supporting arm 10 by providing two notches 64 and 66 in the bottom margin of the supporting arm at a distance apart, into which the front end of the tongue 56 facing the door is inserted, the tongue being bent s that it alternately contacts the inside and outside surface of the associated flange 14 of the supporting arm 10. The front end of tongue 56 lies against the inside surface of the associated flange 14 and is held in place by a projection 68 driven inwardly from the material of flange 14 underneath the end of the tongue. At the cabinet-interior end the tongue is held in place by the fact that the latch 58 is passed through a window 70 (FIGS. 5 and 8) which is provided in an end wall 172 bent down at the rearward end of the supporting arm 10; the height of this window 70 measured at right angles to the cabinet wall is just about equal to the height of the latch 58, while the width of window 70 measured at right angles thereto, transversely of the supporting arm, is selected such that the latches 58 can be squeezed together to a sufficient degree transversely of the supporting arm to come free of the catches 60 in the mounting plate.

We claim:

1. A hinge for hanging a door on the carcase of a cabinet, with a door-related part for fastening to the door and a carcase-related part which is coupled pivotingly to the door-related part by a jointed mechanism, can be fastened removably and adjustably on a mounting plate fastened on the wall of the carcase, and is configured as a supporting arm of a channel-shaped cross section straddling the mounting plate, the door-related part being releasably joined to the mounting plate by a catch mechanism having a coupling means at the front end of the mounting plate and of the supporting arm adjacent the door, which permits the rearward portion of the supporting arm inside of the carcase to pivot relative to the mounting plate, while at the inner end of the supporting arm remote from the door, which at least partially straddles the mounting plate at its end pointing into the carcase interior, two tongues resiliently flexible parallel to the carcase wall surface are provided, each having an extremity engaged with an associated catch in the mounting plate, the extremities and the catches being able to be disengaged by flexing the tongues against one another parallel to the carcase wall surface, and the tongues having finger grips whereby they can be squeezed together in this manner when the supporting arm is mounted on the mounting plate, Wherein the hanger coupling of the supporting arm (10, 11) and the mounting plate (12, 112) is provided with a holding head of spherical shape at least in sections, disposed on a neck (26, 126) of reduced diameter at the cabinet-wall end of a threaded spindle (24, 124) adapted to be screwed into a tap (20, 120) in the web (22, 122) of the supporting arm, said holding head being introduced into a slot (30, 130) in the mounting plate (12, 112) which conforms approximately to the shape of the head (28, 128), is open at the end pointing out of the cabinet for the insertion of the holding head, and narrowed to approximately the diameter of the neck (26, 126) at the top side facing the supporting arm; the latches (58, 158) of the tongues (56, 156) being displaceable by a given amount lengthwise of the supporting arm, parallel to the supporting arm surface, wherein the finger grips are adapted to engage the catches (60, 160) when they are not squeezed together and are secured against disengagement therefrom, and wherein on or in the mounting plate (12, 112) an externally controlled adjusting means (32, 132), which at one end engages the holding head and at the other end engages a portion of the supporting arm, is mounted for movement so that, depending on a direction in which it is operated, it displaces the supporting arm (10, 110) lengthwise by pressing either against the holding head (28, 128) or against a portion of the supporting arm.

2. A hinge in accordance with claim 1, wherein the adjusting means (32) has a threaded spindle (34) screwed in a threaded bore (36) running parallel to the cabinet wall lengthwise through a projection (38) of the mounting plate (12) and opening into the inner end wall of the narrowed slot (30), the front end of which [threaded spindle] facing the linkage mechanism contacting the holding head (28) of the threaded spindle (24) that is introduced into the slot, while at its other end a flange (40) is formed which has an annular surface (42) facing toward the cabinet interior, which is engaged by a tab (44) projecting from the supporting arm (10) toward the mounting plate (12).

3. A hinge in accordance with claim 2, wherein a prolongation (48) reaches centrally from the annular surface (42) of the flange (40) further into the cabinet interior, and has a recess for engagement by tool (52) suitable for rotating the threaded spindle.

4. A hinge in accordance with claim 3, wherein the toolengagement recess is formed in the face of a screw head (50) of enlarged diameter provided on the free end of the prolongation (48).

5. A hinge in accordance with claim 3 or 4, wherein an opening (54) is provided in the carcase-interior end of the supporting arm (10) permitting the introduction of the tool (52) intended for turning the threaded spindle (34).

6. A hinge in accordance with any one of claims 3 or 4, wherein the tab (44) is cut from the web (22) of the supporting arm (10) and then bent into the interior of the supporting arm

7. A hinge in accordance with any one of claims 2 to 4, wherein the holding head (28) is turned cylindrical in its circumferential area (**28*a*) in contact with the end face of the threaded spindle (34) when the supporting arm (10) is in its proper engaged position on the mounting plate (12**).

8. A hinge in accordance with any one of claims 2 to 4, wherein the free end of the tab 44 is urged with resilient bias against the circumferential annular surface (42) of the flange (40).

9. A hinge in accordance with claim 1, wherein the adjusting means (132) is a cam journaled on the mounting plate (12) for rotation about an axis at right angles to the cabinet wall, the circumferential surface of the cam contacting the holding head (128) introduced into the narrowed slot (130) in the mounting plate (112) and, diametrically oppositely, contacting a tab (144) projecting from the supporting arm (110).

10. A hinge in accordance with claim 9, wherein the cam is a disk substantially circular in plan, from whose bottom facing the cabinet wall a pivot (140) excentrically offset from the center of the circle projects, which is journaled in a complementary pivot bore (136) in the mounting plate (112), and in that, in the top of the circular disk (134) facing the web (122) of the supporting arm (110), a recess (148) is provided for engagement of a tool (152) intended for the rotation of the cam.

11. A hinge in accordance with claim 10, wherein, in the web (122) of the supporting arm (110), an opening (154) is provided aligned with the recess (148) in the circular disk (134) for the introduction of the tool (152) intended for the rotation of the cam.

12. A hinge in accordance with claim 10 or 11, wherein the free end of the pivot (140) pointing away from the circular disk protrudes from the pivot bore (136) form®d in the mounting plate (112) and is secured at the protruding end against extraction from the pivot bore (136) in the mounting plate (112) by a radially projecting flange or a radially overlapping washer (150).

13. A hinge in accordance with any one of claims 1 to 4, and 9 to 11, further comprising the tongues (56) releasably holding the supporting arm (10) in the catches (60) on the mounting plate (12) are made each separately from spring-resilient metal strips bent to the intended shape and are fastened to the supporting arm (10).

14. A hinge in accordance with claim 13, further comprising that the end of the material section opposite the end forming the latch (58) of each tongue (56) is locked with the supporting arm (10).

15. A hinge in accordance with claim 14, wherein the end of the tongues (56) locked to the supporting arm (10) is inserted into notches (64, 66) in the free edges of the flanges (14) of the supporting arm (!0) of U-shaped cross section and so bent that it is held alternately in contact with the inside surface and the outside surface of the corresponding flange (14), that the free end of each of the sections of the tongues (56) remote from the latches of the supporting arm preventing the latch from escaping the open notches (64, 66), and that the end of the material section forming the latch (58) of the tongue (56) is guided in a terminal wall (72) bent down at the rearward end of the supporting arm (10), said terminal wall guiding the latch (58) exclusively in the transverse direction.

* * * * *